United States Patent [19]

Brugge et al.

[11] 3,983,810

[45] Oct. 5, 1976

[54] DATA RECORDER WITH INTERLOCK MECHANISM

[75] Inventors: Walter James Brugge, Highland Heights; Edward Francis Takacs, Willoughby, both of Ohio

[73] Assignee: Addressograph Muitigraph Corporation, Shaker Heights, Ohio

[22] Filed: Feb. 4, 1974

[21] Appl. No.: 439,304

[52] U.S. Cl. ..... 101/269

[51] Int. Cl.[2] ..... B41F 3/04

[58] Field of Search ..... 101/45, 56, 269–274, 101/285; 292/99, 101, 114, 128, 129; 312/218, 220, 333

[56] References Cited

UNITED STATES PATENTS

| | | | |
|---|---|---|---|
| 2,935,939 | 5/1960 | Doherty et al. | 101/269 |
| 3,577,917 | 5/1971 | Nantz | 101/269 |
| 3,735,701 | 5/1973 | Ackerman | 101/269 |
| 3,763,777 | 10/1973 | Brown | 101/269 |
| 3,782,276 | 1/1974 | Nakada | 101/56 |
| 3,810,424 | 5/1974 | Barbour | 101/269 |

*Primary Examiner*—Edward M. Coven
*Attorney, Agent, or Firm*—Harry M. Fleck, Jr.

[57] ABSTRACT

A data recorder is provided including a roller platen carriage adapted to be manually reciprocated and normally locked in a home position by a manually releasable interlock mechanism. A release lever is associated with the interlock mechanism, with manual release of the lever being required to free the carriage before each reciprocation. This avoids imprints of unacceptable quality due to inadvertent multiple operations of the carriage.

8 Claims, 7 Drawing Figures

DATA RECORDER WITH INTERLOCK MECHANISM

BACKGROUND OF THE INVENTION

In the past, many data recorders have been provided for imprinting sales slips, or the like, with various embossed data. In recent years, it has been proposed that such imprinted data be read optically by specialized optical character recognition equipment to provide the data in a format suitable for computer purposes, which typically are utilized for billing purposes. The limited capabilities of most OCR equipment is such that the imprinted information must be of high quality to provide reliable reading. It has been found, for instance, that if a form, such as a sales slip, is imprinted more than once by roller platen it may be smeared to the point where it will not be readily recognized by the OCR equipment. Accordingly, it is desired to provide a data recorder with appropriate means for preventing the inadvertent operation of the roller platen carriage more than a single time when imprinting the same form.

Data recorders have been provided in the past with interlock mechanisms which prevented operation of the platen carriage unless a group of variable imprint wheels were set to a predetermined position. This prevented inadvertent imprinting of the sales slips with an amount of the previous sale. One such data recorder is disclosed by U.S. Pat. No. 3,722,405, assigned to the assignee of the present invention. It will be appreciated that while the apparatus disclosed by this patent prevents inadvertent multiple imprints, it does so through a mechanism associated with the variable amount wheels.

It is an object of the present invention to provide a novel data recorder of a type which does not necessarily include variable amount print wheels and which is provided with an interlock mechanism which must be manually released prior to each carriage reciprocation.

Another object of the present invention is to provide a unique data recorder including an interlock mechanism which is automatically returned to the locking position by movement of the carriage from its home position, whereby the carriage is automatically latched upon its return. It is a further object of the present invention to provide a data recorder with a versatile interlock lever including a backup or secondary reset surface which effects reset of the lever by the carriage in the event the lever is inadvertently manipulated to the set position after the carriage is moved from its home position.

Still another object of the present invention is to provide a novel data recorder interlock mechanism which includes a minimum number of moving parts, yet is highly reliable and inexpensive to manufacture and maintain.

SUMMARY OF THE INVENTION

The present invention is generally related to data recorders and, more particularly, to an interlock mechanism which avoids inadvertent multiple reciprocations of the platen carriage. The interlock mechanism is comprised of a lever which normally locks or latches a roller platen carriage in its home position. A release actuator associated with the lever is conveniently located for manipulation by the operator in order to free the carriage for reciprocation. As the platen carriage is reciprocated to perform the imprint operation, it coacts with the interlock lever to effect reset thereof. Movement of the lever between the set and reset positions is aided by an overcenter spring arrangement which also serves to hold the lever in one of these two positions. As the carriage approaches its home position on the return stroke, the lever is engaged by the carriage and pivoted slightly short of its over-center position. This allows passage of the carriage and ultimately latches or locks the carriage in the home position. If the lever is advertently manipulated to the release or set position while the carriage is being reciprocated, a second reset surface on the lever is engaged by the carriage to effect reset on the return stroke.

DESCRIPTION OF THE PREFERRED EMBODIMENT

Figure 1:
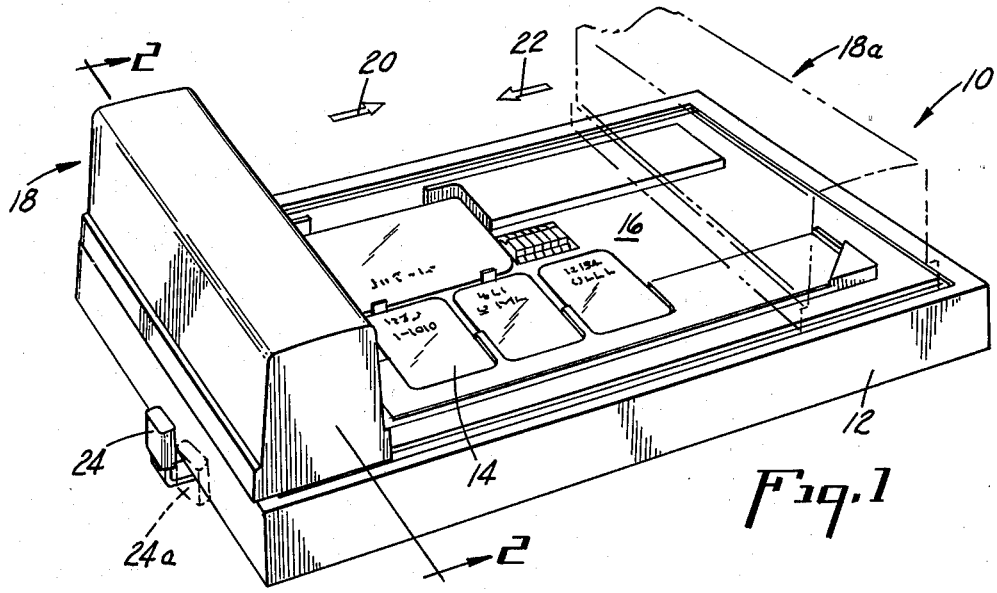
FIG. 1 is a perspective view of the data recorder of the present invention with a phantom view of the manual actuator in the released position and the platen carriage at the right end of travel.

Referring now, more particularly, to FIG. 1 of the drawings, the data recorder of the present invention is generally indicated by the numeral 10 and includes a stationary base or frame 12 which supports a plurality of embossed data cards 14 mounted on a rigid bed 16. A roller platen carriage, generally indicated by the numeral 18, is movably mounted to frame 12 for reciprocation over the data cards during an imprint operation. In performing an imprint, the carriage is moved to the right, as indicated by arrow 20 to the position shown in phantom at **18*a*. The carriage is then returned in the direction indicated by arrow 22 to the home position. The recorder is provided with a release lever or actuator 24 located on the left side of frame 12. The lever is normally in the position illustrated in a solid line and is manually movable to a "set" or "release position" as shown in phantom at 24*a*. When actuator 24 is in its normal or reset position, carriage 18 is locked against movement, as hereinafter explained. In order to free the imprint carriage, the operator must manipulate lever 24 to release position 24*a*** prior to each imprint reciprocation.

Figure 2:
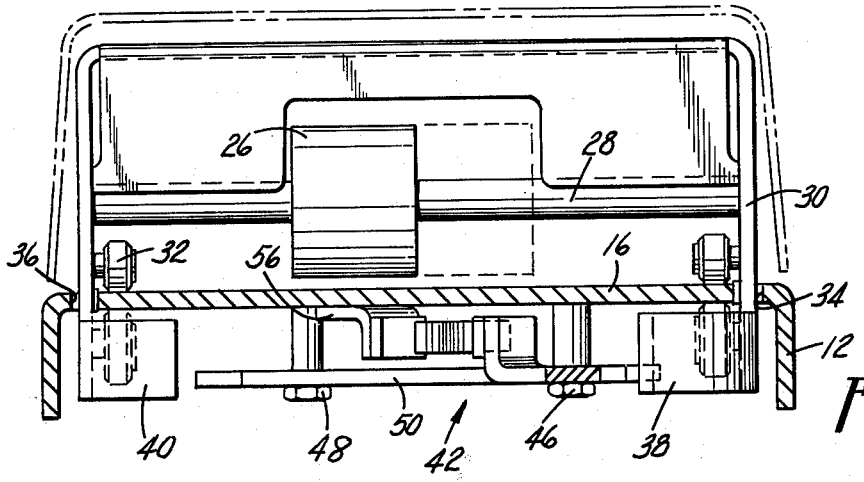
FIG. 2 is a sectional view taken along section 2—2 of FIG. 1 with the platen cover shown in phantom.
Figure 3:
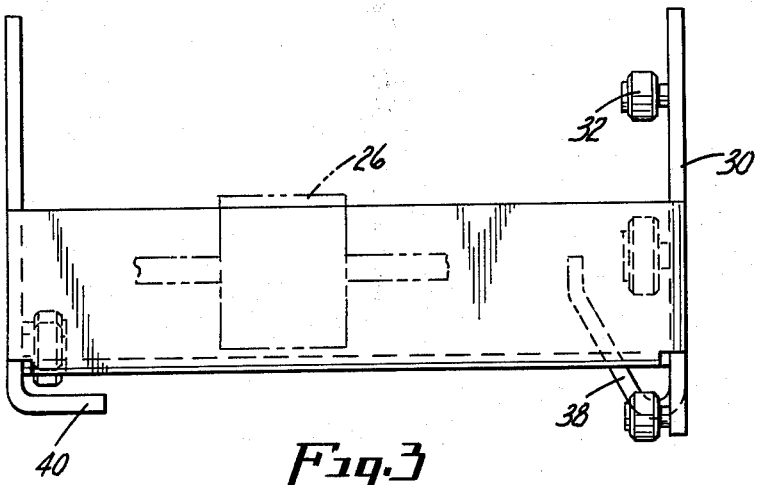
FIG. 3 is a top plan view of the platen carriage removed from the assembly and with the roller platen shown in phantom.

With reference to FIGS. 2 and 3, the construction of the roller platen carriage may be seen in more detail. Preferably, the carriage supports a shiftable roller platen 26, which is rotatably mounted to a support shaft 28 and is axially movable thereon between the positions shown in solid and phantom in FIG. 2. The roller platen is in one axial position during forward travel of the carriage and is shifted to the second axial position for return travel to the home position. Thus, the roller platen causes imprint of different embossed data during forward and return travel of the carriage. This results in a single imprint for each reciprocation of the platen carriage.

The mechanism which controls shifting of the roller platen is not illustrated in the drawings for the sake of clarity. Such mechanisms are well known to those skilled in the data recorder art and a detailed description of such is felt unnecessary for the purposes of this disclosure. One such shifting platen mechanism is disclosed by U.S. Pat. No. 3,750,569, assigned to the assignee of the present invention. It will be appreciated that other appropriate platen mechanisms may be utilized which also provide a single imprint for each carriage reciprocation. For example, the double roller platen disclosed in U.S. Pat. No. 3,763,777, assigned to the assignee of the present invention, may be utilized, if desired.

It will be observed that the platen carriage includes framework 30 which is supported by a plurality of guide wheels or rollers 32 which engage the upper and lower surfaces of bed 16. Side portions of framework 30 extend downwardly through elongated slots 34 and 36 and terminate at latch element 38 and reset element of 40 generally disposed under bed 16. An interlock mechanism generally indicated by the numeral 42 is mounted to the underside of bed 16. The mechanism includes an interlock lever 50, pivotally mounted to a bolt 46 and including surfaces which cooperate with latch and reset elements 38 and 40 of the platen carriage, as hereinafter explained.

Referring now to FIGS. 4–7, operation of the interlock mechanism may be more fully understood. As mentioned above, the purpose of the interlock mechanism is to avoid inadvertent multiple reciprocations of the imprint carriage which could cause blurred imprinting of unacceptably quality for OCR reading. Manual actuator 24 is integral with, or affixed to, interlock 50 to impart pivotal movement thereto to release the platen carriage. A bolt 48 fastened to bed 16 passes through an arcuate slot 52 in the interlock plate. This provides a pair of stops which define the pivotal travel limits of the interlock lever. A C spring 54 is mounted between a stationary seat 56 and a movable seat 58 attached to interlock lever 50. Seat 56 is mounted to the underside of bed 16 or to some other appropriate stationary point associated with the data recorder frame. The C spring provides an over-center type snap action which influences the interlock lever toward either the set position or the reset position. In order to aid the C spring action toward the reset position, a coil tension spring 60 is mounted between the interlock lever and an appropriate stationary anchor 62 on the underside of bed 16. This spring provides mild tension forces which act in a direction influencing the interlock lever toward the reset position.

Figure 4:
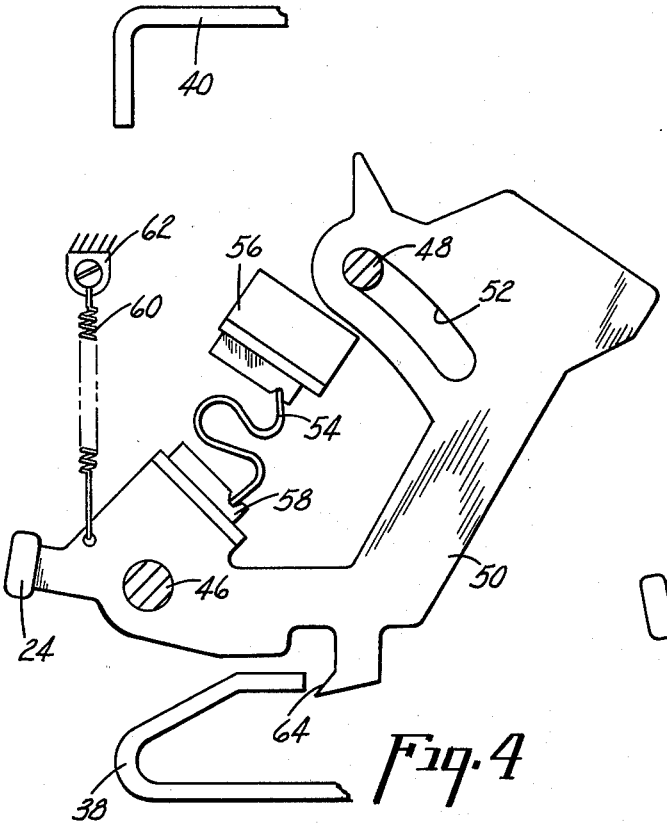
FIG. 4 is a top plan view of the interlock mechanism in the reset or locked position and with the associated carriage elements in the home position.

Interlock lever 50 is provided with a finger or tab which defines latch surface 64 and is disposed in the path of travel of carriage latch element 38 when the interlock is in the reset position. This condition is best illustrated in FIG. 4, wherein the carriage is in the home position and latch element 38 is spaced very slightly from latch surface 64, but prevented from significant travel to the right. The platen carriage may be released by manipulation of actuator 24 in a downward direction from the position illustrated in FIG. 4, to pivot the interlock lever in a counterclockwise direction. This removes latch surface 64 from the path of travel of latch element 38.

Figure 5:
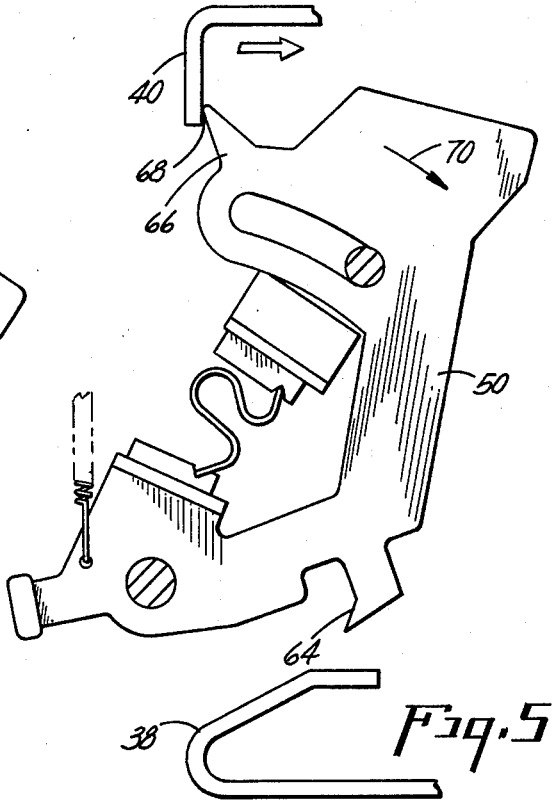
FIG. 5 is a top plan view of the interlock mechanism similar to FIG. 4 but in a set position and with the carriage reset element engaging the interlock lever to effect reset as the carriage is moved from its home position.

The release or set position of the interlock lever is illustrated in FIG. 5. As mentioned above, after manual release has been effected, the interlock mechanism is returned to its original position by motion of the carriage during the imprint operation. Interlock lever is provided with a reset finger 66 having a primary reset surface 68 which is engaged by carriage reset element 40 as the platen carriage is moved away from its home position. This causes the interlock lever to pivot in a clockwise direction as indicated by the arrow at 70. The interlock lever is pivoted pass the over-center position, where the forces of C spring 54 and tension spring 60 take over to pivot the lever fully to the reset position. It will be appreciated that the reset operation occurs with the carriage spaced from its home position. This assures adequate clearance between latch surface 64 and latch element 38 to allow free return of the interlock lever to the reset position.

Figure 6:
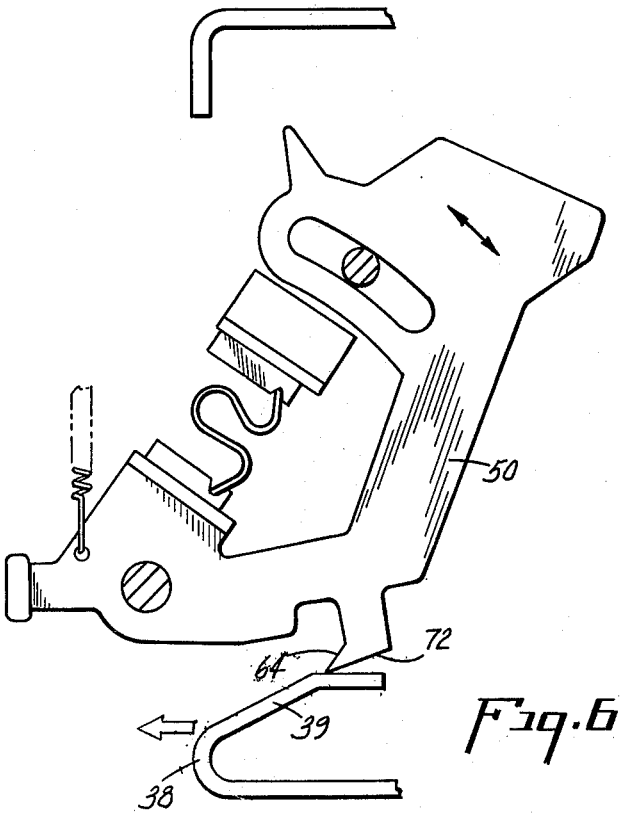
FIG. 6 is a top plan view of the interlock mechanism illustrating partial pivoting of the interlock lever to allow return latching of the carriage.

With particular reference to FIG. 6, operation of the interlock mechanism during return of the platen carriage may be more fully understood. It will be appreciated that the tab which defines latch surface 64 also defines a return cam surface 72 which is engaged by cooperating surface on latch element 38 during the return stroke of the platen carriage. Preferably, latch element 38 is provided with a portion 39 formed at an angle to the direction of carriage travel, such that it cams the interlock lever slightly in a counterclockwise direction on the return stroke. This counterclockwise motion falls short of the over-center position, but is sufficient to allow passage of the carriage latch element to its home position. Once the latch element has passed the return cam surface 72, the interlock lever is returned fully to its reset position under the influence of springs 54 and 60. This latches or locks the carriage in the home position, making manual release necessary before the carriage is freed for the next imprint operation.

Figure 7:
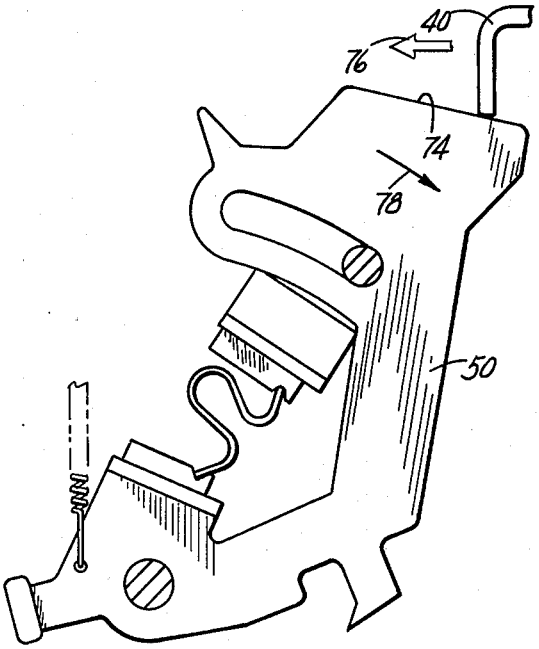
FIG. 7 is a top plan view of the interlock mechanism in the set position and with the carriage reset element engaging the interlock lever for reset on the return stroke.

The lever mechanism associated with the present invention also provides automatic reset in response to carriage travel in the event that the lever is inadvertently moved to the release position during the imprint operation. With particular reference to FIG. 7 this backup or secondary reset function may be more fully understood. Interlock lever 50 is provided with a secondary or backup reset surface 74 which is disposed within the path of travel of reset element 40 if the lever is in the reset position during the return stroke. During carriage return, reset element 40 is moving in the direction indicated by arrow 76 such that it comes in positive engagement with the secondary reset surface 74. This causes clockwise pivotal movement of the interlock lever in a direction indicated by the arrow at 78. The interlock lever is influenced beyond the over-center position, whereby the springs take over to effect full return to the reset position. Preferably, this operation occurs before the latch element 38 goes through its return camming operation illustrated in FIG. 6. Although the geometry may be altered to provide this reset operation very close to the carriage home position, such that return camming is bypassed.

From the foregoing description, it will be appreciated that the data recorder and associated interlock mechanism of the present invention provide a relatively simple, yet highly versatile, means of avoiding multiple imprinting of sales slips and other forms which could result in blurred imprinting, unacceptable for OCR techniques. The interlock mechanism requires a minimum number of moving parts, yet provides automatic reset in response to carriage travel in either direction. Of course, it is not intended that the present invention be limited to the exact lever configuration illustrated in the drawings, as variations thereof may be readily apparent to those skilled in the art. Furthermore, it is foreseeable that other biasing spring arrangements may be utilized to provide the over-center snap action and return of the interlock lever to the reset position. It is possible that the coil tension spring 60 associated with the interlock mechanism may be eliminated and still provide acceptable snap action. However, with the preferred embodiment, the coil tension spring was found to desirably enhance operation of the interlock mechanism.

While the invention has been particularly shown and described with reference to the preferred embodiment, it will be understood by those skilled in the art that various changes in form and detail may be made without the parting from the spirit and scope of the invention.

What is claimed is:

1. A data recorder apparatus comprising:

a stationary frame;

a movable platen carriage reciprocally mounted to said frame for selective movement on a path of travel between first and second positions;

an interlock lever pivotally mounted to said frame and movable between set and reset positions;

an actuator connected to said lever for manual movement thereof to said set position; and biasing means operatively connected to said lever for selectively, yieldably holding said lever in said set position or said reset position, said carriage including a latch element, said lever including a latch surface disposed in the path of travel of said latch element when said lever is in said reset position whereby movement of said carriage in a first direction from said first position toward said second position is inhibited, said latch surface being remote from the path of travel of said latch element when said lever is in said set position whereby said carriage is free to travel in said first direction, said carriage including a reset element, said lever including a primary reset surface which is engaged by said reset element during movement of said carriage in said first direction when said lever is in said set position whereby said lever is returned to said reset position, said lever including a secondary reset surface disposed in the path of travel of said reset element when said lever is in said set position and engaged by said reset element when said carriage is traveling in a second direction opposite said first direction in the event said lever is manipulated to said set position after it is reset by said primary reset surface and before return of said carriage to said first position.

2. The apparatus set forth in claim 1 wherein said lever includes a return cam surface means which is slidably engaged by said latch element during travel in said second direction toward said first position for moving said lever away from said reset position to permit return of said carriage to said first position when said lever is in said reset position.

3. The apparatus set forth in claim 2 wherein said biasing means includes over-center spring means connected between said frame and said lever.

4. The apparatus set forth in claim 3 wherein said sliding engagement between said return cam surface means and said latch element causes partial pivotal movement of said lever short of the over-center position, whereby said lever returns to said reset position after set latch element passes said return cam surface.

5. A data recorder apparatus for imprinting embossed data onto a form or the like, said apparatus comprising:

a stationary frame adapted to accommodate embossed data;

a movable platen carriage reciprocally mounted to said frame for selective movement along a path of travel between first and second positions to perform an imprint function; and interlock means carried by said frame having set and reset conditions, said interlock means inhibiting movement of said carriage in a first direction from said first position toward said second position when in said reset condition and allowing movement of said carriage in said first direction when in said set condition, said interlock means including an interlock member having a latch surface disposed in said path of travel and in effective retentive engagement with said carriage when said interlock member is in said reset condition, and manual actuator means for selectively moving said interlock member to said set condition to free said carriage for initial travel of said carriage in said first direction and return travel in a second direction opposite said first direction, said interlock means including primary reset surface means disposed in said path of carriage travel when said interlock member is in said set condition to return said interlock member to said reset condition in response to movement of said carriage in said first direction and secondary reset surface means disposed in said path of carriage travel when said interlock member is in said set condition to return said interlock member to said reset condition in response to movement of said carriage in said second direction in the event said interlock is moved to said set condition after reset by said primary reset surface means and before return of said carriage to said first position.

6. The apparatus set forth in claim 5 further including biasing means operatively connected to said interlock member for selectively, yieldably holding said interlock member in said reset position or said set position.

7. The apparatus set forth in claim 5 wherein a portion of said manual actuator means extends outwardly from said stationary frame for convenient access.

8. The apparatus set forth in claim 5 including a roller platen mounted to said carriage and means for controlled shifting of said roller platen transversely of said path of travel in response to movement of said carriage to said second position, whereby a single imprint of the embossed data is made for each reciprocation of said carriage between said first and second positions.

* * * * *